US007052438B2

(12) United States Patent
Eschenbach

(10) Patent No.: US 7,052,438 B2
(45) Date of Patent: May 30, 2006

(54) ELLIPTICAL EXERCISE APPARATUS CAMS

(76) Inventor: Paul William Eschenbach, 290 S. Tyger La., Roebuck, SC (US) 29376

( * ) Notice: Subject to any disclaimer, the term of this patent is extended or adjusted under 35 U.S.C. 154(b) by 0 days.

(21) Appl. No.: 10/939,439

(22) Filed: Sep. 14, 2004

(65) Prior Publication Data

US 2006/0058159 A1 Mar. 16, 2006

(51) Int. Cl.
*A63B 69/16* (2006.01)
*A63B 22/04* (2006.01)

(52) U.S. Cl. ..... 482/52; 482/51; 482/57

(58) Field of Classification Search ..... 482/51–53, 482/57, 70, 79–80
See application file for complete search history.

(56) References Cited

U.S. PATENT DOCUMENTS

| | | | | |
|---|---|---|---|---|
| 5,788,610 A | 8/1998 | Eschenbach | ..... | 482/52 |
| 6,019,710 A | 2/2000 | Dalebout et al. | ..... | 482/70 |
| 6,042,512 A | 3/2000 | Eschenbach | ..... | 482/52 |
| 6,045,487 A * | 4/2000 | Miller | ..... | 482/52 |
| 6,217,486 B1 | 4/2001 | Rosenow | ..... | 482/52 |
| 6,238,321 B1 | 5/2001 | Arnold et al. | ..... | 482/52 |
| 6,361,476 B1 | 3/2002 | Eschenbach | ..... | 482/52 |

* cited by examiner

*Primary Examiner*—Stephen R. Crow

(57) ABSTRACT

The present invention relates to a standup exercise apparatus that simulates walking, jogging and climbing with arm exercise. More particularly, the present invention relates to an exercise machine having separately supported pedals for the feet and arm exercise coordinated with the motion of the feet. Elliptical cross trainers guide the feet along a generally elliptical shaped curve to simulate the motions of jogging and climbing. Existing elliptical cross trainers often use excessive pedal articulation which can overwork the ankle to achieve a longer stride. The present invention is an improved elliptical exercise machine capable of extended exercise with less pedal articulation that is more ankle friendly. One end of a foot support member is guided by a guide link for back and forth movement while the other end is guided by a drive link with cam guide to drive an alternator and flywheel. The resulting pedal motion-is foot friendly. Stride length can be adjusted. Handles are coordinated with the foot support members for arm exercise.

22 Claims, 4 Drawing Sheets

ELLIPTICAL EXERCISE APPARATUS CAMS

BACKGROUND OF THE INVENTION

1. Field

The present invention relates to a standup exercise apparatus that simulates walking, jogging and climbing with arm exercise. More particularly, the present invention relates to an exercise machine having separately supported pedals for the feet and arm exercise coordinated with the motion of the feet.

2. State of the Art

The benefits of regular exercise to improve overall health, appearance and longevity are well documented in the literature. For exercise enthusiasts the search continues for safe apparatus that provides full body exercise for maximum benefit in minimum time.

Recently, a new category of exercise equipment has appeared on the commercial market called elliptical cross trainers. These cross trainers guide the feet along a generally elliptical shaped curve to simulate the motions of jogging and climbing. Generally they use long cranks to generate a long foot stride having excessive pedal articulation. There is a need for an elliptical exercise machine capable of a similar long stride using a linkage to modify a shorter crank.

Standup pedal exercise combined with arm levers attached to the pedals is shown in Kummerlin et al. German Pat. No. 2,919,494 and in Geschwender U.S. Pat. No. 4,786,050. Standup pedal exercise coupled with oscillating swing arms is shown in Miller U.S. Pat. Nos. 5,242,343 and 5,383,829 and in Eschenbach U.S. Pat. No. 5,423,729. All of these exercise machines use pedals having two pedal pivots which are guided by a first circular guide path curve generated by a crank which rotates through one full revolution during a pedal cycle and a second arc guide path curve generated by a rocker link or track.

Eschenbach in U.S. Pat. No. 5,788,610 shows the use of cam tracks in a front drive elliptical design. Several rear drive elliptical cross trainers are shown by Eschenbach in U.S. Pat. Nos. 6,042,512 and 6,361,476. Rosenow in U.S. Pat. No. 6,217,486 and Arnold et al. in U.S. Pat. No. 6,238,321 show typical commercial rear drive elliptical cross trainers in use today.

Dalebout et al. in U.S. Pat. No. 6,019,710 shows a stroke rail slidably attached to a frame to generate an elliptical pedal path. Rosenow in U.S. Pat. No. 6,217,486 shows a cam as part of a crank to raise and lower a foot support member for an elliptical cross trainer.

There is a need for a pedal operated exercise machine that can be safely operated in the standup position whereby the arms and legs can be exercised with the feet moving through a generally elliptical movement without excessive pedal articulation. There is also a need to adjust the stride length while maintaining less pedal articulation.

It is one objective of this invention to provide an elliptical pedal movement with a path generating linkage that provides a long stride with less pedal articulation. Excessive pedal articulation causes ankle stress. Another object of this invention is to provide an adjustable stride.

SUMMARY OF THE INVENTION

The present invention relates to the kinematic motion control of pedals which simulate running, climbing and cycling during several modes of operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an oblong or elongate curve motion while pedal angles vary during the pedal cycle to maintain the heel of the foot generally in contact with the pedal with less pedal articulation. As the foot is raised, the heel of the foot remains generally in contact with the inclining pedal for safer operation. Arm exercise is by arm levers coordinated with the mechanism guiding the foot pedals.

In the preferred embodiment, the apparatus includes a separate pedal for each foot, each pedal being extended by a foot support member and partially supported by an orbital oblong guide path at the first portion of the foot support member. The oblong guide path generating linkage has a crank arm which completes one full revolution during a pedal cycle and is phased generally opposite the crank arm for the other pedal through a crankshaft pivot axis attached to the framework.

A drive link is connected to the crank arm pivot and to the first portion of the foot support member. A drive link guide often referred to as a cam is attached to the framework. A guide contact is connected to the drive link and is engaged with the drive link guide. A roller can be used as the cam contact. For the preferred embodiment, the drive link guide has an elongate curve shape and the drive link is nonaligned.

A second portion of the foot support member is supported with a pivot by a guide link which is pivotally connected to the framework. As the crank arms are driven by foot motion, the pedals follows an elongate curve approximating an ellipse having less pedal articulation than other elliptical cross trainers having long crank arms. Alternately, the guide links can be replaced with guides in contact with rollers positioned on the foot support member.

Arm exercise is provided with handles pivotally connected to the framework and coordinated with the guide links. When the foot is forward, the handle corresponding to that foot is generally rearward.

Load resistance is imposed upon the crank arms through pulleys and belts from a flywheel and alternator. A control system regulates the load on the alternator to vary the resistance to exercise. The resistance can be varied during operation through a control system within easy reach of the operator. Other forms of load resistance such as friction, magnetic, air, belt, etc. may also be used.

Movement of the pedals cause the first portion of the foot support member to follow an elongate orbital path similar to an ellipse where the longer major axis of the ellipse is generally horizontal to provide the longer stride length. The shorter minor axis of the ellipse results in less pedal articulation.

In an alternate embodiment, the cam guide can be linear. The linear cam guide or elongate curve guide can be repositioned to change the path of the foot pedal. In this embodiment, an actuator is used as part of a control system to reposition the cam guide.

In an other alternate embodiment, a second pair of cam guides are added having a different shape as part of a magazine. The first cam guide is disengaged from the drive link contact and rotated as part of the magazine to the side while the second cam guide replaces the first cam guide to be engaged with the drive link contact. The second cam guide is configured to shorten the pedal path. The magazine can be expanded to contain additional cam guide shapes for additional foot pedal paths. Stepping motors can also be used to activate the cam guide changes as part of the control system.

In summary, this invention provides the operator with stable foot pedal support having motions that simulate running, climbing and cycling with very low joint impact and upper body exercise. The pedal motion exhibits a long stride with less pedal articulation common to other elliptical trainers for less ankle stress regardless of stride length. Further, the foot pedal path can be changed.

DETAILED DESCRIPTION OF THE EMBODIMENTS

Figure 1:
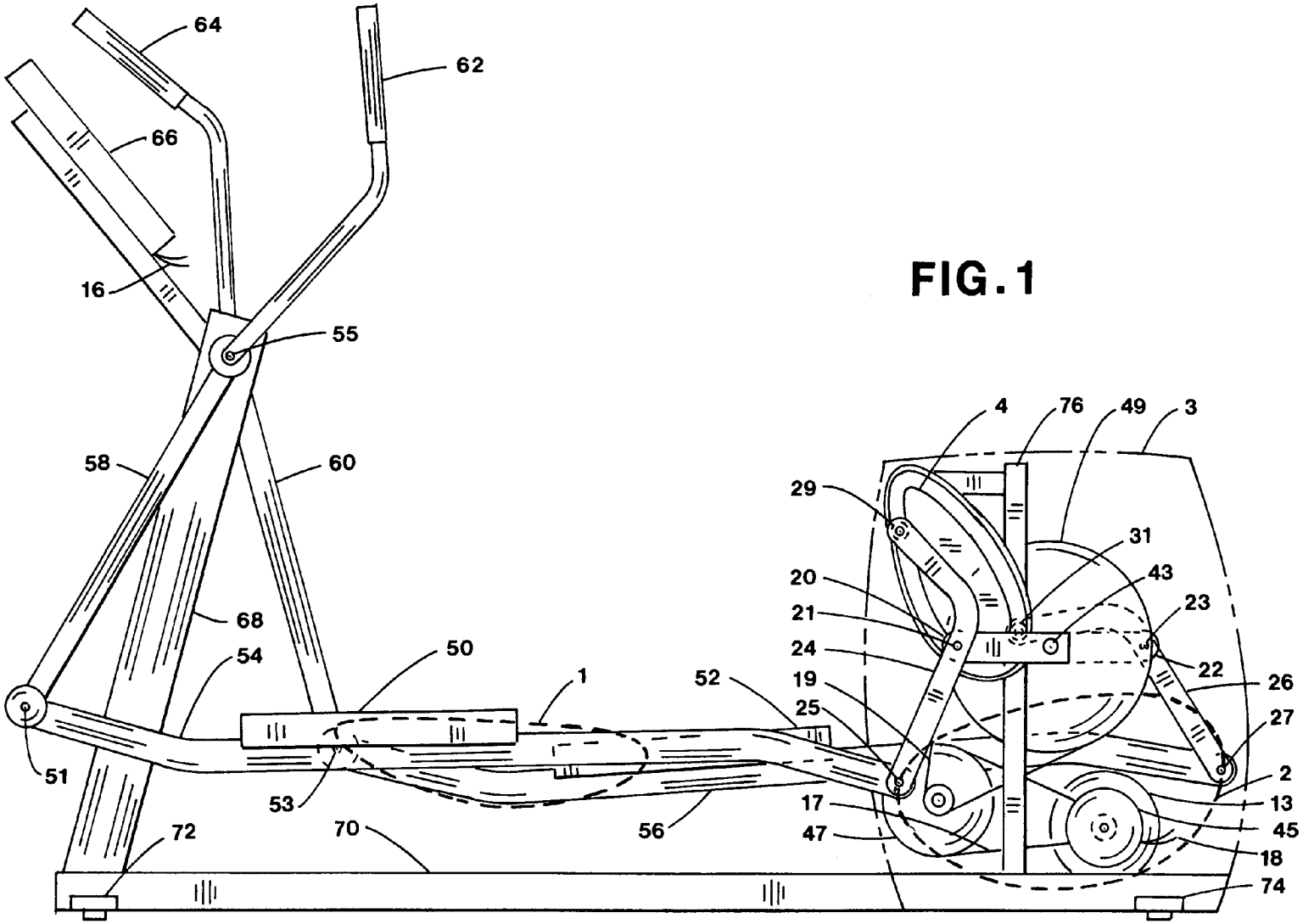
FIG. 1 is a right side elevation view of the preferred embodiment of an exercise machine constructed in accordance with the present invention.
Figure 2:
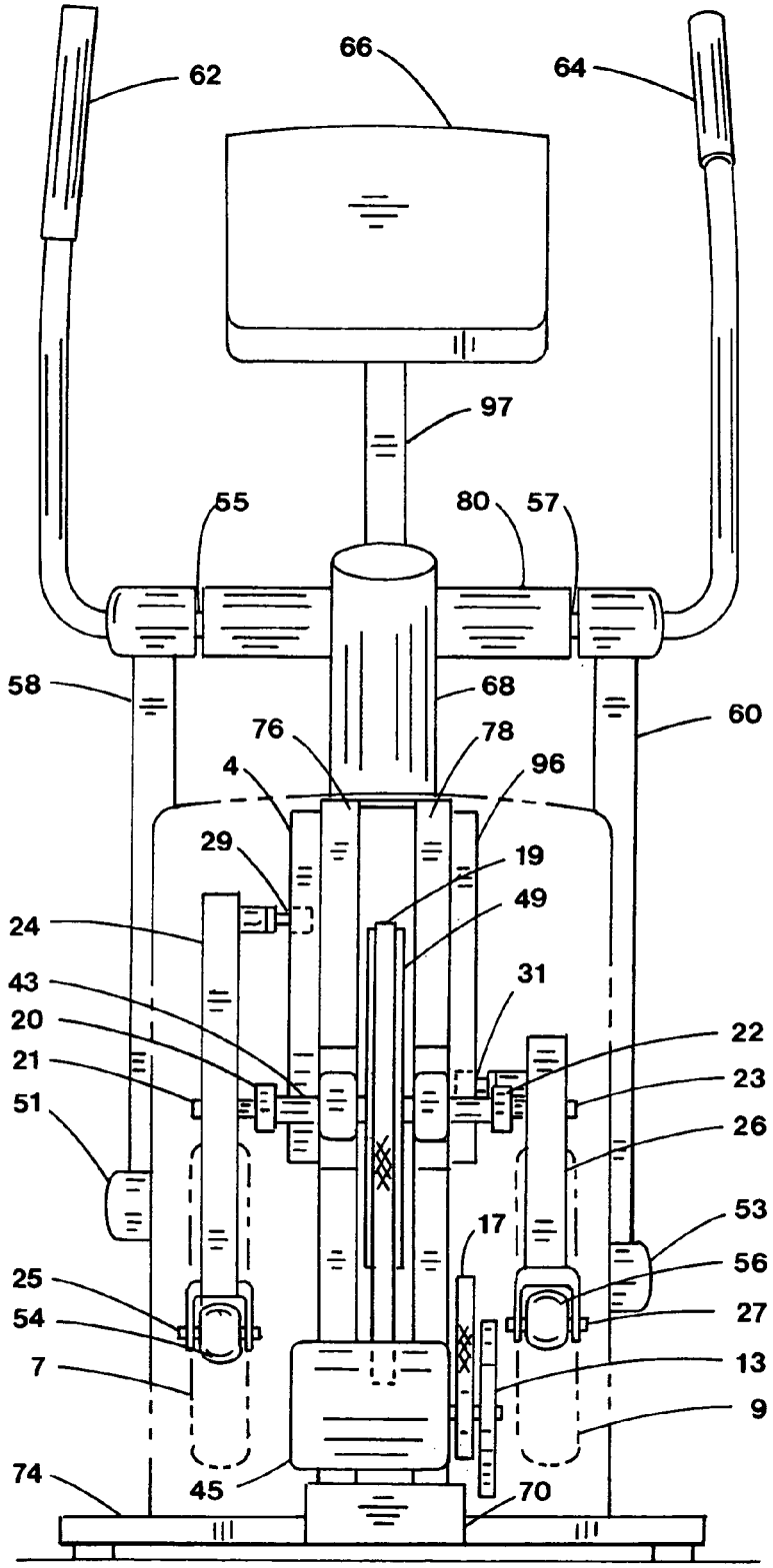
FIG. 2 is the rear view of the preferred embodiment shown in FIG. 1.

Referring to the drawings in detail, pedals 50 and 52 are shown in FIGS. 1 and 2 in the most forward and rearward positions of the first embodiment. Pedals 50 and 52 are supported by foot support members 54 and 56 and traverse an elongate closed loop path 1. Foot support members 54,56 are connected to guide links 58,60 at pivots 51,53 and connected to drive links 24,26 at pivots 25,27. Guide links 58,60 are connected to frame member 80 at pivots 55,57.

Drive links 24,26 are connected to crank arms 20,22. Crank arms 20,22 are joined as generally opposed at pivot axis 43 to form a crank. Cam guides 4,96 are attached to frame members 76,78. Cam contacts 29,31 are connected to drive links 24,26 and are engaged with cam guides 4,96. Cam contacts 29,31 are offset relative to that portion of drive links 24,26 that contain pivots 21,23 and 25,27 to lower shroud 3.

Drive links 24,26, crank arms 20,22 and cam guides 4,96 form a pair of path generating linkages configured to guide the first portion of the foot support member 54,56 along orbital path 2. For this configuration, note that path 2 followed by the end of foot support members 54,56 does not orbit first pivot axis 43.

Handles 62,64 are attached to guide links 58,60 for arm exercise. Pulley 49 is attached to crank arms 20,22 and rotates about pivot axis 43 to drive alternator 45 and flywheel 13 through belts 17,19 and step-up pulley 47. Alternator 45 is supported by frame 70 and is connected to controller 66 by wires 16,18 using conventional wiring (not shown). Controller 66 is attached to frame member 68 by support 97 and works with alternator 45 to provide variable resistance to exercise using conventional methods. A shroud 3 is shown with slots 7,9 to enclose the drive system to allow foot support members 54,56 to protrude.

Horizontal member 80 supports guide pivots 55,57 and is attached to frame member 70 by upright support 68. First crank pivot axis 43 and second crank pivot axis 41 are supported by upright members 76,78 which are attached to frame member 70. Cross members 72,74 are supported by the floor and attach to frame member 70. Pulley 47 is supported by a pulley support (not shown) attached to frame member 70.

Figure 3:
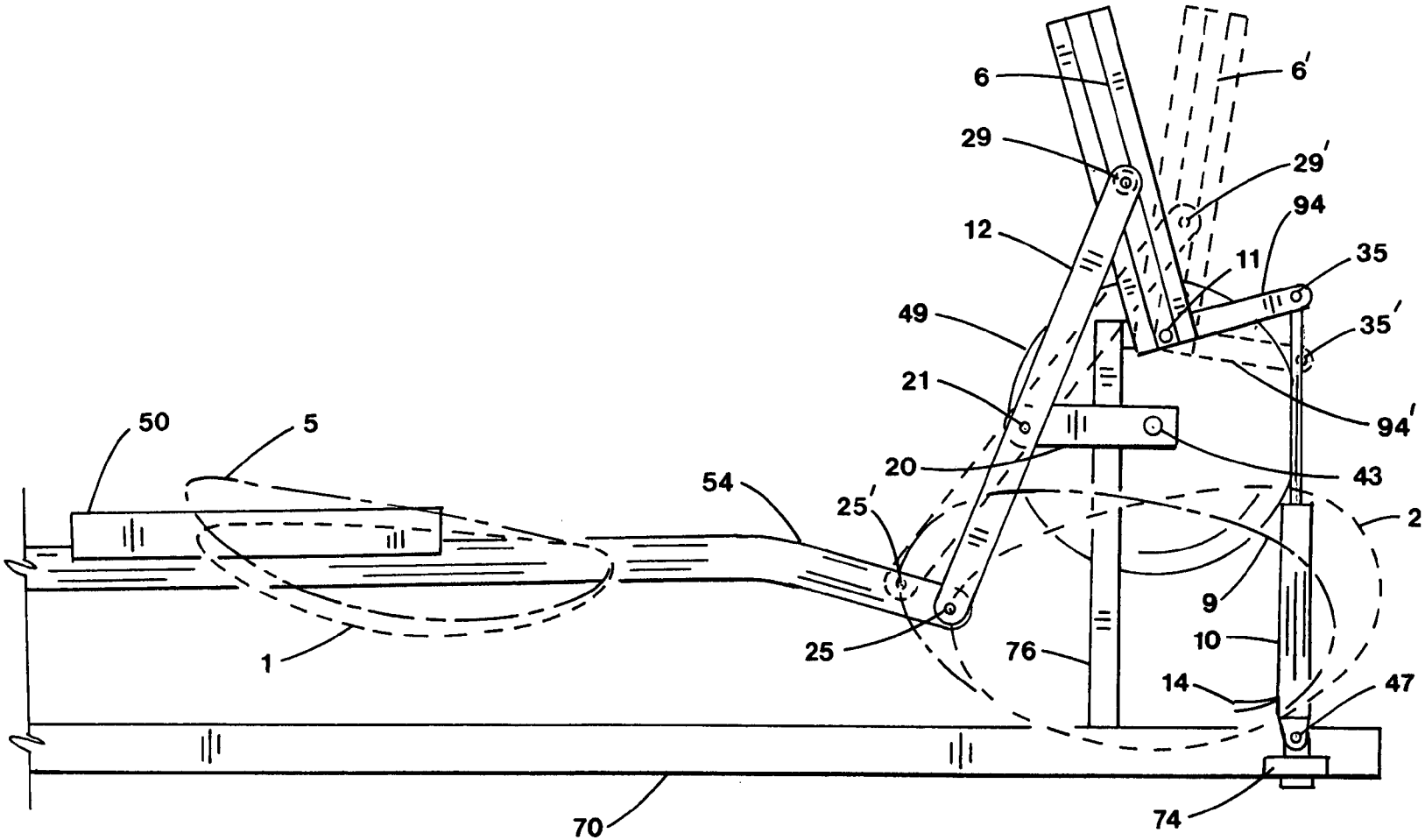
FIG. 3 is is a side elevation view of an alternate embodiment having a linear cam guide.

An alternate embodiment is shown in FIG. 3 where the cam guide 6 is linear and movable. Cam guide 6 is connected to frame member 76 at pivot 11. Cam guide extension 94 is connected to actuator 10 at pivot 35. Actuator 10 is connected to crossover member 74 at pivot 47 and has wiring 14 operably associated with control system 66 by conventional means (not shown). When actuator 10 is contracted, cam guide 6 is rotated about pivot 11 to position 6' with cam guide extension 94' at pivot 35'. Drive link 24 now has pivots relocated to 25' and 29'. Drive link pivot 25' now follows orbital curve 9 which results in pedal curve 5. The companion foot support member 56 and front end of the apparatus are the same as the preferred embodiment and not shown for clarity.

Figure 4:
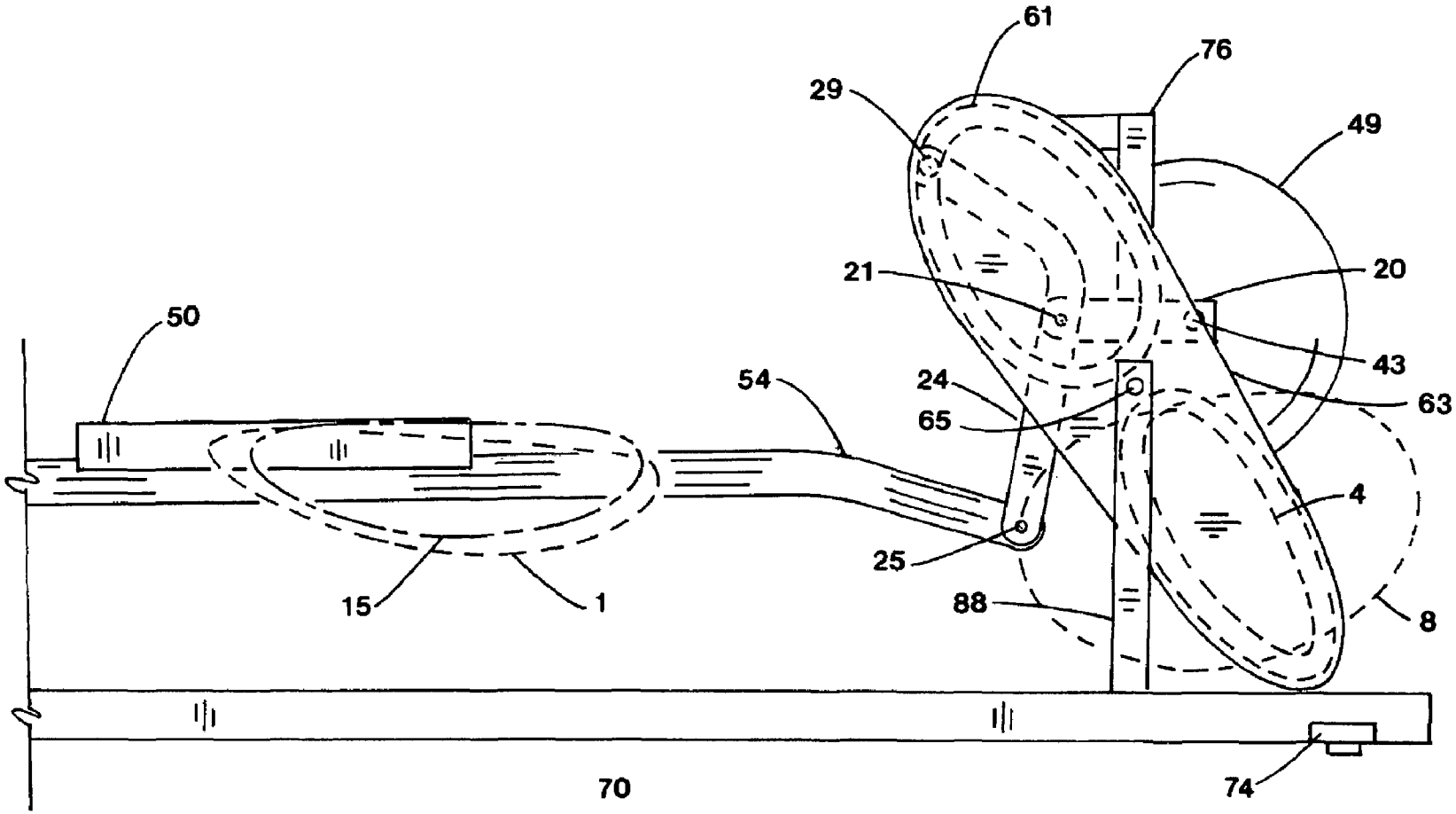
FIG. 4 is a side view of another alternate embodiment having a cam guide magazine.

Another alternate embodiment is shown in FIG. 4 where cam guide magazine 63 is shown connected to frame member 88 at pivot 65. Magazine 63 contains cam guide 4 and a second cam guide 61 shown engaged with cam contact 29. The different cam guide 61 results in a shorter foot path 15. After cam guide 61 is disengaged from cam contact 29, magazine 63 can be rotated about pivot 65 to position cam guide 4 in the proper position to engage cam contact 29. After locking magazine 63 in place, drive link 24 can be moved to generate pedal path 1. Magazine 63 can be expanded to contain additional cam guide shapes (not shown). Further, a stepping motor can be added (not shown) to change the cam guides from control system 66. The companion foot support member 56 and front end of the apparatus are the same as the preferred embodiment and not shown for clarity.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise apparatus comprising:

a framework, said framework configured to be supported by the floor;

a pair of foot support members, each having a first portion, a second portion and a foot engaging pedal;

a crank, said crank rotatably attached to said framework projecting outwardly therefrom on both sides thereof;

a pair of drive links, each said drive link pivotally connected to said crank at a medial portion of each drive link and to said first portion of a respective said foot support member;

a pair of drive link guides, each said drive link guide attached to said framework;

a pair of guide contacts, each said guide contact connected to a respective second end portion of said drive link and operably associated with said drive link guide;

a pair of guide links, each said guide link pivotally connected to a respective said foot support member and said framework to cause said second portion of said foot support member to have a back and forth movement;

said pedal configured to move relative to said framework when the foot of the user is rotating said crank whereby said pedal follows an oblong curve path.

2. The exercise apparatus according to claim 1 wherein said drive link guide is movable.

3. The exercise apparatus according to claim 1 further comprising arm exercise, said arm exercise operably associated with said foot support members.

4. The exercise apparatus according to claim 3 wherein said arm exercise comprises a pair of handles, each said handle operably associated with a corresponding said foot support member.

5. The exercise apparatus according to claim 1 further comprising a flywheel, said flywheel rotatably connected to said framework and operably associated with said crank.

6. The exercise apparatus according to claim 5 further comprising a load resistance, said load resistance operably associated with said flywheel, a means for adjustment of said load resistance and, a control system, said control system positioned within reach of the operator whereby said load resistance can be varied during operation of said exercise machine.

7. The exercise apparatus according to claim 1 wherein said guide link contact is a roller, said roller in rollable contact with said drive link guide.

8. The exercise apparatus according to claim 1 further comprising a second pair of drive link guides, said second pair of drive link guides being movable to replace said first pair of drive link guides.

9. The exercise apparatus according to claim 1 further comprising an actuator, said actuator operably associated with said drive link guide and said framework to reposition said drive link guide.

10. The exercise apparatus according to claim 1 further comprising a shroud, said shroud encompassing said crank, said drive link guides, said drive links and said first portion of said foot support members whereby said first portion of said foot support members protrude from said shroud.

11. The exercise apparatus according to claim 1 wherein said drive link is nonaligned such that said guide contact is offset relative to that portion of said drive link that contains the pivots for said foot support member and said crank.

12. An exercise apparatus comprising:

a framework, said framework configured to be supported by the floor;

a pair of foot support members, each having a first portion, a second portion and a foot engaging pedal;

a pair of crank arms, each said crank arm rotatably attached to said framework at a common pivot axis;

a pair of drive links, each said drive link pivotally connected to a respective said crank arm and to said first portion of a respective said foot support member;

a pair of cams, each said cam attached to said framework;

a pair of cam contacts, each said cam contact connected to a respective said drive link and engaged with a respective said cam;

a pair of guide links, each said guide link operably associated with a respective said foot support member and said framework to cause said second portion of said foot support member to have a back and forth movement;

said pedal configured to move relative to said framework when the foot of the user is rotating said crank whereby said first portion of said foot support member follows an orbital path to exclude encompassing said pivot axis.

13. The exercise apparatus according to claim 12 further comprising a second pair of cams, said second pair of cams being movable to replace said first pair of cams.

14. The exercise apparatus according to claim 12 further comprising a load resistance, said load resistance operably associated with said crank arms, a means for adjustment of said load resistance and, a control system, said control system positioned within reach of the operator whereby said load resistance can be varied during operation of said exercise machine.

15. The exercise apparatus according to claim 14 further comprising an actuator, said actuator operably associated with said cam and said framework to reposition said cam using said control system.

16. The exercise apparatus according to claim 12 further comprising arm exercise, said arm exercise operably associated with said foot support members.

17. The exercise apparatus according to claim 12 wherein said drive link is nonaligned such that said cam contact is offset relative to that portion of said drive link that contains the pivots for said foot support member and said crank arm.

18. An exercise apparatus comprising:

a framework, said framework configured to be supported by the floor;

a pair of foot support members, each having a first portion, a second portion and a foot engaging pedal;

a crank, said crank rotatably attached to said framework projecting outwardly therefrom on both sides thereof;

a pair of drive links, each said drive link pivotally connected to said crank and to said first portion of a respective said foot support member;

a pair of drive link guides each comprising a closed loop path, each said drive link guide movably attached to said framework and operably associated with a respective drive link;

a means to reposition said drive link guides;

a pair of guides, each said guide operably associated with a respective said foot support member and said framework to cause said second portion of said foot support member to have a back and forth movement;

said pedal configured to move relative to said framework when the foot of the user is rotating said crank whereby said pedal follows an oblong curve path that can be changed with adjustment of said drive link guides.

19. The exercise apparatus according to claim 18 further comprising a pair of handles for arm exercise, each said handle pivotally connected to said framework and operably associated with a respective said foot support member.

20. The exercise apparatus according to claim 18 further comprising a second pair of drive link guides, said second pair of drive link guides being movable to replace said first pair of drive link guides.

21. The exercise apparatus according to claim 18 further comprising a load resistance, said load resistance operably associated with said crank, a means for adjustment of said load resistance and, a control system, said control system positioned within reach of the operator whereby said load resistance can be varied during operation of said exercise machine.

22. The exercise apparatus according to claim 21 wherein said means to reposition said drive link guides is operable with said control system to change said oblong curve path.

* * * * *